US009206644B2

(12) United States Patent
Clark et al.

(10) Patent No.: US 9,206,644 B2
(45) Date of Patent: Dec. 8, 2015

(54) POSITIVE DISPLACEMENT MOTOR (PDM) ROTARY STEERABLE SYSTEM (RSS) AND APPARATUS

(71) Applicant: Schlumberger Technology Corporation, Sugar Land, TX (US)

(72) Inventors: Brian Oliver Clark, Sugar Land, TX (US); Keith A. Moriarty, Houston, TX (US); Raphael Gadot, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 213 days.

(21) Appl. No.: 13/798,086

(22) Filed: Mar. 13, 2013

(65) Prior Publication Data

US 2014/0097026 A1 Apr. 10, 2014

Related U.S. Application Data

(60) Provisional application No. 61/704,805, filed on Sep. 24, 2012, provisional application No. 61/704,758, filed on Sep. 24, 2012.

(51) Int. Cl.

| | |
|---|---|
| ***E21B 4/02*** | (2006.01) |
| ***E21B 7/06*** | (2006.01) |
| ***E21B 17/02*** | (2006.01) |
| ***E21B 7/04*** | (2006.01) |

(52) U.S. Cl.

CPC ... *E21B 7/04* (2013.01); *E21B 4/02* (2013.01); *E21B 7/068* (2013.01); *E21B 17/028* (2013.01)

(58) Field of Classification Search

CPC ..... E21B 7/04; E21B 7/068; E21B 4/02; E21B 17/028

See application file for complete search history.

(56) References Cited

U.S. PATENT DOCUMENTS

| | | | | |
|---|---|---|---|---|
| 5,265,682 | A * | 11/1993 | Russell et al. | 175/45 |
| 5,394,951 | A | 3/1995 | Pringle et al. | |
| 5,484,029 | A * | 1/1996 | Eddison | 175/73 |
| 6,047,784 | A | 4/2000 | Dorel | |
| 6,392,561 | B1 | 5/2002 | Davies et al. | |
| 6,419,014 | B1 | 7/2002 | Meek et al. | |
| 6,427,783 | B2 | 8/2002 | Krueger et al. | |
| 6,533,178 | B1 * | 3/2003 | Gaul et al. | 235/492 |
| 7,190,084 | B2 | 3/2007 | Hall et al. | |
| 7,552,761 | B2 | 6/2009 | Moriarty | |

(Continued)

FOREIGN PATENT DOCUMENTS

| | | | |
|---|---|---|---|
| RU | 2213370 | C2 | 9/2003 |
| WO | 2010005881 | A1 | 1/2010 |

OTHER PUBLICATIONS

International Search Report and the Written Opinion for International Application No. PCT/US2013/061266 dated Jan. 23, 2014.

*Primary Examiner* — Jennifer H Gay
(74) *Attorney, Agent, or Firm* — John Vereb

(57) ABSTRACT

A motor steering system includes a drill collar, a transmitter circuit having a power transmitting coil, a rotor, and a receiver circuit having a power receiving coil. The transmitter circuit is coupled to the drill collar and the receiver circuit is coupled to the rotor such that the transmitter circuit and the receiver circuit are positioned with respect to one another such that power is coupled from the power transmitting coil to the power receiving coil whereby the drill collar provides electric power to the rotor.

20 Claims, 15 Drawing Sheets

(56) References Cited

U.S. PATENT DOCUMENTS

| | | | | |
|---|---|---|---|---|
| 7,566,235 | B2 * | 7/2009 | Bottos et al. | 439/191 |
| 7,591,304 | B2 | 9/2009 | Juhasz et al. | |
| 7,666,668 | B2 | 2/2010 | Bujard et al. | |
| 8,146,679 | B2 | 4/2012 | Downton | |
| 8,408,333 | B2 | 4/2013 | Pai et al. | |
| 8,827,006 | B2 * | 9/2014 | Moriarty | 175/40 |
| 8,890,341 | B2 * | 11/2014 | Ocalan et al. | 290/1 R |
| 8,905,159 | B2 * | 12/2014 | Downton | 175/61 |
| 2003/0127252 | A1 | 7/2003 | Downton et al. | |
| 2004/0262043 | A1 * | 12/2004 | Schuaf | 175/57 |
| 2005/0252688 | A1 | 11/2005 | Head et al. | |
| 2006/0054354 | A1 | 3/2006 | Orban | |
| 2006/0260806 | A1 | 11/2006 | Moriarty | |
| 2007/0018848 | A1 | 1/2007 | Bottos et al. | |
| 2007/0261887 | A1 | 11/2007 | Pai et al. | |
| 2008/0277163 | A1 | 11/2008 | Moriarty | |
| 2010/0006341 | A1 * | 1/2010 | Downton | 175/61 |
| 2010/0018770 | A1 | 1/2010 | Moriarty et al. | |
| 2014/0097026 | A1 * | 4/2014 | Clark et al. | 175/61 |

* cited by examiner 5-5 Cross Section

POSITIVE DISPLACEMENT MOTOR (PDM) ROTARY STEERABLE SYSTEM (RSS) AND APPARATUS

CROSS-REFERENCE TO RELATED APPLICATIONS

This application claims the benefit of and priority to U.S. Provisional Patent Application Ser. No. 61/704,805, entitled "System And Method For Wireless Power And Data Transmission In A Mud Motor," and filed on Sep. 24, 2012, and U.S. Provisional Patent Application Ser. No. 61/704,758, entitled "Positive Displacement Motor Rotary Steerable System And Apparatus," and filed on Sep. 24, 2012, the disclosures of which are hereby incorporated by reference in their entireties.

DESCRIPTION OF THE RELATED ART

There are many situations where transferring electrical power from one device to another via wires is impractical, overly complicated or impossible. For example, difficulties in running wires might be due to relative motion between the two devices, the physical distance between the two devices, or a wet environment which could lead to short circuiting the electrical power where contacts are used.

For efficient power transfer, conventional inductive couplers may attempt to minimize magnetic flux leakage between the primary and the secondary coils. Magnetic flux leakage occurs when the coils are physically separated, when their magnetic cores have air gaps, or when their relative positions vary. These conditions result in the primary and secondary coils being relatively weakly coupled. When such flux leakage is relatively large, this results in relatively low efficiency for transferring power between the two coils.

SUMMARY OF THE DISCLOSURE

A motor steering system includes a drill collar, a transmitter circuit having a power transmitting coil, a rotor, and a receiver circuit having a power receiving coil. The transmitter coil is coupled to the drill collar and the receiver coil is coupled to the rotor such that the transmitter coil and the receiver coil are positioned with respect to one another such that power is coupled from the power transmitting coil to the power receiving coil whereby the drill collar provides electrical power to the rotor.

The system described below mentions how power may flow from above the mud motor to the rotary steerable system ("RSS"). One of ordinary skill in the art recognizes that power may easily flow in the other direction. Accordingly, embodiments of the system described herein may transmit power in either direction and/or in both directions as understood by one of ordinary skill in the art.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass parts having the same reference numeral in figures.

DETAILED DESCRIPTION

Figure 1A:
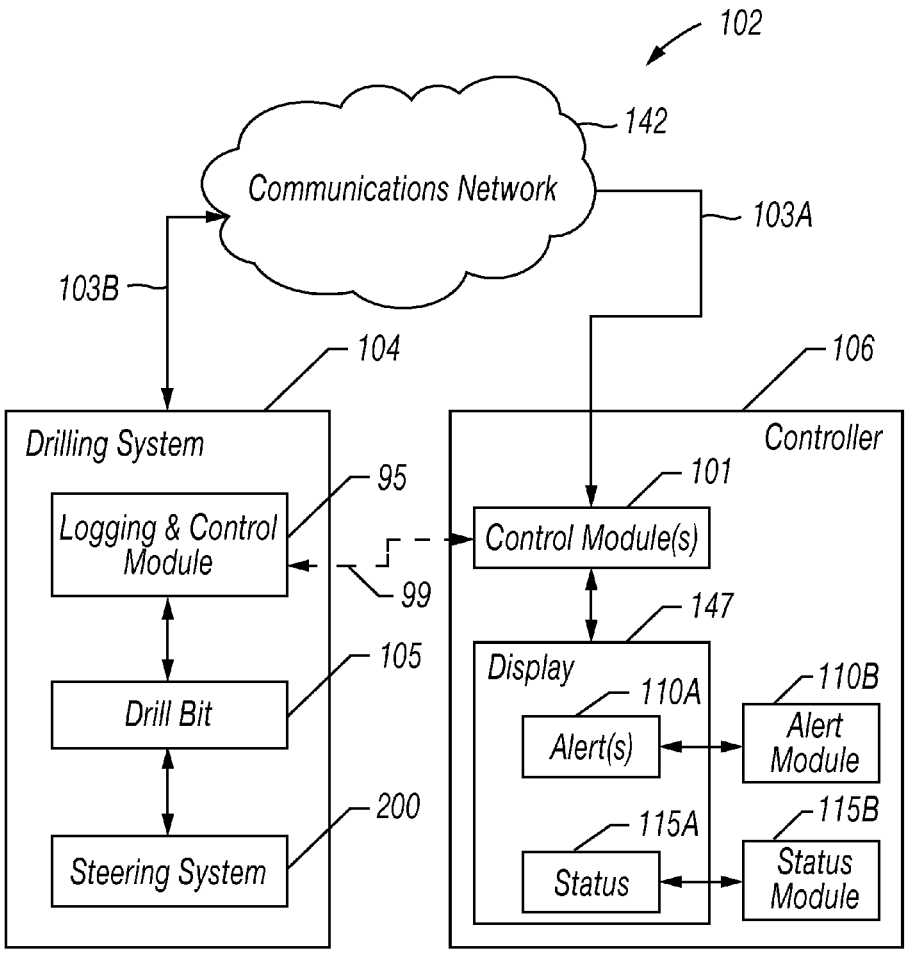
FIG. 1A is a diagram of a system for controlling and monitoring a drilling operation.

Referring initially to FIG. 1A, this figure is a diagram of a system 102 for controlling and monitoring a drilling operation. The system 102 includes a controller module 101 that is part of a controller 106. The system 102 also includes a drilling system 104, which has a logging and control module 95, a drill bit 105 and a steering system 200. The controller 106 further includes a display 147 for conveying alerts 110A and status information 115A that are produced by an alerts module 110B and a status module 115B. The controller 102 may communicate with the drilling system 104 via a communications network 142.

The controller 106 and the drilling system 104 may be coupled to the communications network 142 via communication links 103A and/or 103B. Many of the system elements illustrated in FIG. 1A are coupled via communications links 103A and/or 103B to the communications network 142.

The links 103A and/or 103B illustrated in FIG. 1A may include wired or wireless couplings or links. Wireless links include, but are not limited to, radio-frequency ("RF") links, infrared links, acoustic links, and other wireless mediums. The communications network 142 may include a wide area network ("WAN"), a local area network ("LAN"), the Internet, a Public Switched Telephony Network ("PSTN"), a paging network, or a combination thereof. The communications network 142 may be established by broadcast RF transceiver towers (not illustrated). However, one of ordinary skill in the art recognizes that other types of communication devices besides broadcast RF transceiver towers are included within the scope of this disclosure for establishing the communications network 142.

The drilling system 104 and controller 106 of the system 102 may have RF antennas so that each element may establish wireless communication links 103A and/or 103B with the communications network 142 via RF transceiver towers (not illustrated). Alternatively, the controller 106 and drilling system 104 of the system 102 may be directly coupled to the communications network 142 with a wired connection. The controller 106 in some instances may communicate directly with the drilling system 104 as indicated by dashed line 99 or the controller 106 may communicate indirectly with the drilling system 104 using the communications network 142.

The controller module 101 may include software or hardware (or both). The controller module 101 may generate the alerts 110A that may be rendered on the display 147. The alerts 110A may be visual in nature but they may also include audible alerts as understood by one of ordinary skill in the art.

The display 147 may include a computer screen or other visual device. The display 147 may be part of a separate stand-alone portable computing device that is coupled to the logging and control module 95 of the drilling system 104. The logging and control module 95 may include hardware or software (or both) for direct control of a bottom hole assembly 100 as understood by one of ordinary skill in the art.

Figure 1B:
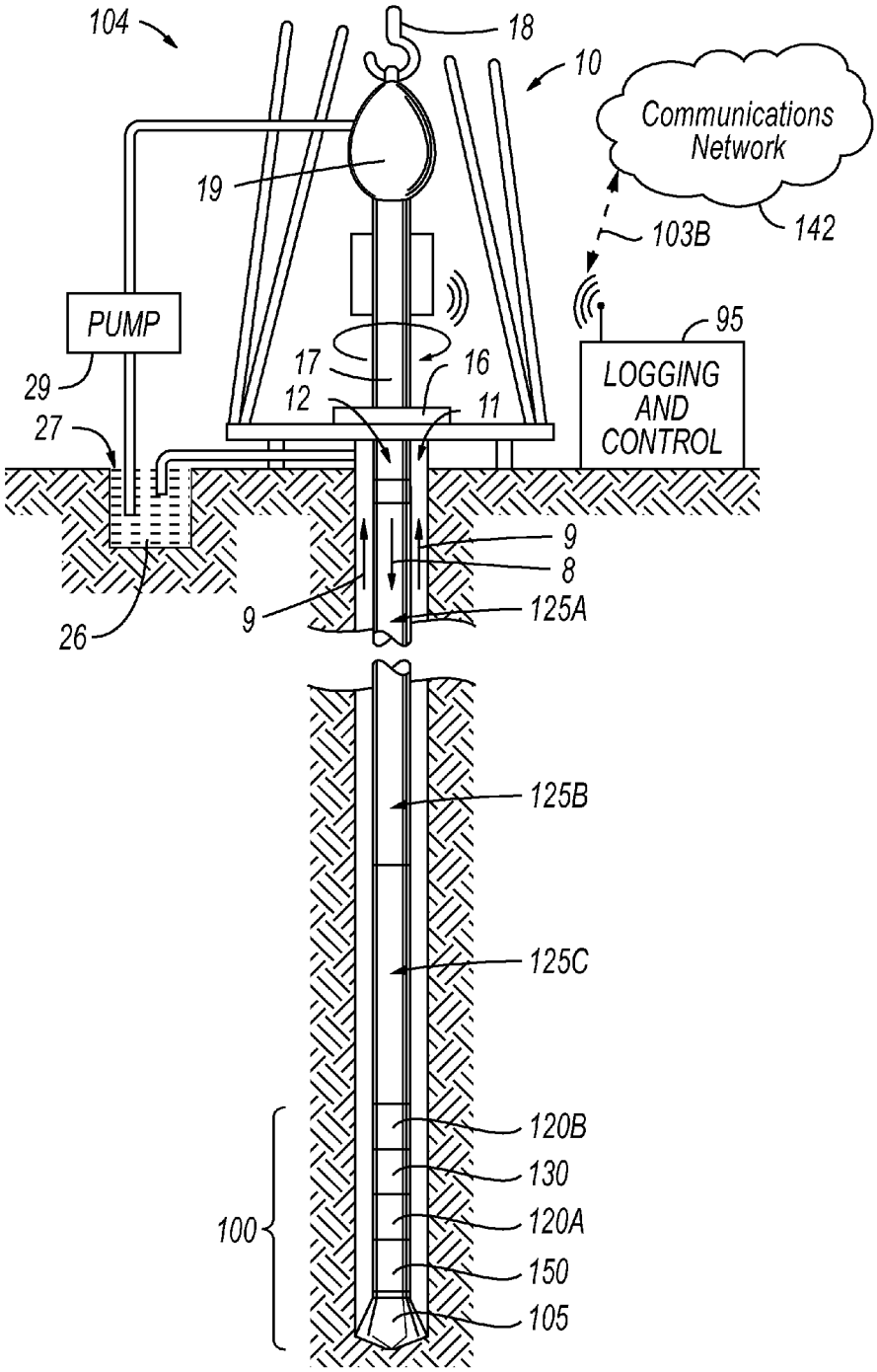
FIG. 1B is a diagram of a wellsite drilling system that forms part of the system illustrated in FIG. 1A.

FIG. 1B illustrates a wellsite drilling system 104 that forms part of the system 102 illustrated in FIG. 1A. The wellsite can be onshore or offshore. In this system 104, a borehole 11 is formed in subsurface formations by rotary drilling in a manner that is known to one of ordinary skill in the art. Embodiments of the system 104 can also use directional drilling, as will be described hereinafter. The drilling system 104 includes the logging and control module 95 as discussed above in connection with FIG. 1A.

A drill string 12 is suspended within the borehole 11 and has a bottom hole assembly ("BHA") 100, which includes the drill bit 105 at its lower end. The surface system includes platform and derrick assembly 10 positioned over the borehole 11, the assembly 10 including a rotary table 16, a kelly 17, a hook 18 and a rotary swivel 19. The drill string 12 is rotated by the rotary table 16, energized by means not shown, which engages the kelly 17 at the upper end of the drill string. The drill string 12 is suspended from the hook 18, attached to a traveling block (also not shown), through the kelly 17 and the rotary swivel 19, which permits rotation of the drill string 12 relative to the hook 18. As is known to one of ordinary skill in the art, a top drive system could alternatively be used instead of the kelly 17 and rotary table 16 to rotate the drill string 12 from the surface. The drill string 12 may be assembled from a plurality of segments 125A, 125B, and/or 125C of pipe and/or collars threadedly joined end to end.

In the embodiment of FIG. 1B, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12, as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this system as understood by one of ordinary skill in the art, the drilling fluid 26 lubricates the drill bit 105 and carries formation cuttings up to the surface as it is returned to the pit 27 for cleaning and recirculation.

The bottom hole assembly 100 of the illustrated embodiment may include at least one logging-while-drilling (LWD) module 120A and/or 120B, a measuring-while-drilling (MWD) module 130, a rotary-steerable system and motor 150 (see PDM assembly 280 in FIG. 15), and the drill bit 105.

The LWD module 120A and/or 120B may be housed in a special type of drill collar, as is known to one of ordinary skill in the art, and can contain one or a plurality of known types of logging tools. Also, it will be understood that more than one LWD module 120A and/or 120B and/or MWD module 130 can be employed, e.g., as represented at 120A. (References, throughout, to a module at the position of 120A can alternatively mean a module at the position of 120B as well.) The LWD module 120A and/or 120B includes may include capabilities for measuring, processing, and storing information, as well as for communicating with the surface equipment. In the present embodiment, the LWD module 120A and/or 120B includes may include a directional resistivity measuring device.

The MWD module 130 is also housed in a special type of drill collar, as is known to one of ordinary skill in the art, and can contain one or more devices for measuring characteristics of the drill string 12 and the drill bit 105. The MWD module 130 may further include an apparatus (not shown) for generating electrical power to the downhole system 100.

This apparatus may include a mud turbine generator powered by the flow of the drilling fluid 26, although it should be understood by one of ordinary skill in the art that other power and/or battery systems may be employed. In the embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The foregoing examples of wireline and drill string conveyance of a well logging instrument are not to be construed as a limitation on the types of conveyance that may be used for the well logging instrument. Any other conveyance known to one of ordinary skill in the art may be used, including without limitation, slickline (solid wire cable), coiled tubing, well tractor and production tubing.

Figure 2:
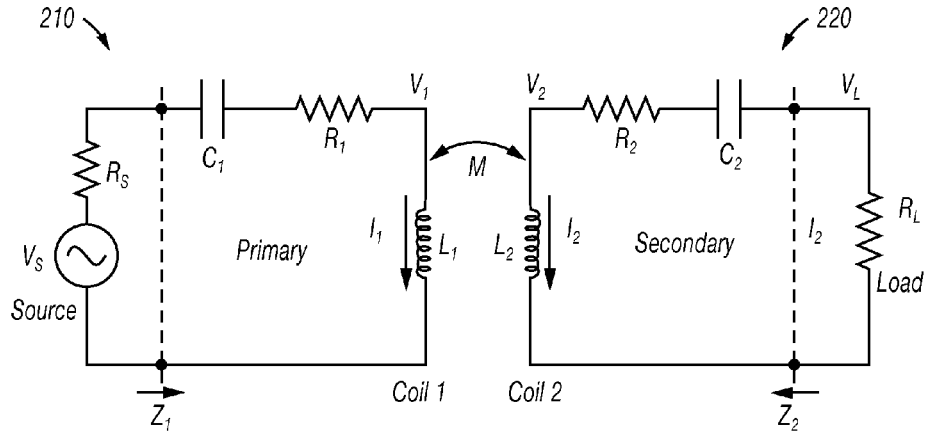
FIG. 2 is a schematic diagram illustrating a primary transmitting circuit and a secondary receiving circuit.

With respect to transferring electrical power from one device to another, one approach is to use an oscillating magnetic field to transfer power from one device to another without requiring connecting wires. The relatively efficient transfer of electrical power between two weakly coupled coils can be accomplished using resonantly tuned circuits and impedance matching techniques. To compensate for the flux leakage, both coils are resonated at the same frequency. Furthermore, the source resistance is matched to the impedance looking toward the load, and the load resistance is matched to the impedance looking toward the source. Such can be used within the steering system 200 shown in FIG. 1A FIG. 2 is a schematic drawing depicting a primary or transmitting circuit 210 and a secondary or receiving circuit 220. In this description, the time dependence is assumed to be exp(jωt) where ω=2πf and f is the frequency in Hertz. Returning to the FIG. 2 illustration, the transmitting coil is represented as an inductance $L_1$ and the receiving coil as $L_2$. In the primary circuit 210, a voltage generator with constant output voltage $V_S$ and source resistance $R_S$ drives a current $I_1$ through a tuning capacitor $C_1$ and primary coil having self-inductance $L_1$ and series resistance $R_1$. The secondary circuit 220 has self-inductance $L_2$ and series resistance $R_2$. The resistances, $R_1$ and $R_2$, may be due to the coils' wires, to losses in the coils magnetic cores (if present), and to conductive materials or mediums surrounding the coils. The Emf (electromotive force) generated in the receiving coil is $V_2$, which drives current $I_2$ through the load resistance $R_L$ and tuning capacitor $C_2$. The mutual inductance between the two coils is M, and the coupling coefficient k is defined as:

$$k=M/\sqrt{L_1L_2} \tag{1}$$

While a conventional inductive coupler has k≈1, weakly coupled coils may have a value for k less than 1 such as, for example, less than or equal to about 0.9. To compensate for weak coupling, the primary and secondary coils in the various embodiments are resonated at the same frequency. The resonance frequency is calculated as:

$$\omega_0 = \frac{1}{\sqrt{L_1C_1}} = \frac{1}{\sqrt{L_2C_2}} \tag{1}$$

At resonance, the reactance due to $L_1$ is cancelled by the reactance due to $C_1$. Similarly, the reactance due to $L_2$ is cancelled by the reactance due to $C_2$. Efficient power transfer may occur at the resonance frequency, $f_0=\omega_0/2\pi$. In addition, both coils may be associated with high quality factors, defined as:

$$Q_1 = \frac{\omega L_1}{R_1} \text{ and } Q_2 = \frac{\omega L_2}{R_2}. \tag{3}$$

The quality factors, Q, may be greater than or equal to about 10 and in some embodiments greater than or equal to about 100. As is understood by one of ordinary skill in the art, the quality factor of a coil is a dimensionless parameter that characterizes the coil's bandwidth relative to its center frequency and, as such, a higher Q value may thus indicate a lower rate of energy loss as compared to coils with lower Q values.

If the coils are loosely coupled such that k<1, then efficient power transfer may be achieved provided the figure of merit, U, is larger than one such as, for example, greater than or equal to about 3:

$$U=k\sqrt{Q_1Q_2}>>1 \tag{4}$$

The primary and secondary circuits are coupled together via:

$$V_1=j\omega L_1I_1+j\omega MI_2 \text{ and } V_2=j\omega L_2I_2+j\omega MI_1, \tag{5}$$

where $V_1$ is the voltage across the transmitting coil. Note that the current is defined as clockwise in the primary circuit and counterclockwise in the secondary circuit. The power delivered to the load resistance is:

$$P_L = \frac{1}{2}R_L|I_2|^2, \tag{6}$$

while the maximum theoretical power output from the fixed voltage source $V_S$ into a load is:

$$P_{MAX} = \frac{|V_S|^2}{8R_S}. \tag{7}$$

The power efficiency is defined as the power delivered to the load divided by the maximum possible power output from the source, $$\eta \equiv \frac{P_L}{P_{MAX}}. \tag{8}$$

In order to optimize the power efficiency, η, the source resistance may be matched to the impedance of the rest of the circuitry. Referring to FIG. 2, $Z_1$ is the impedance looking from the source toward the load and is given by:

$$Z_1 = R_1 - j/(\omega C_1) + j\omega L_1 + \frac{\omega^2M^2}{R_2 + R_L + j\omega L_2 - j/(\omega C_2)} \tag{9}$$

When $\omega=\omega_0$, $Z_1$ is purely resistive and may equal $R_S$ for maximum efficiency.

$$Z_1 = R_1 + \frac{\omega^2M^2}{R_2 + R_L} \equiv R_S. \tag{10}$$

Similarly, the impedance seen by the load looking back toward the source is $$Z_2 = R_2 - j/(\omega C_2) + j\omega L_2 + \frac{\omega^2M^2}{R_1 + R_S + j\omega L_1 - j/(\omega C_1)} \tag{11}$$

When $\omega=\omega_0$, $Z_2$ is purely resistive and $R_L$ should equal $Z_2$ for maximum efficiency $$Z_2 = R_2 + \frac{\omega^2M^2}{R_1 + R_S} \equiv R_L. \tag{12}$$

The power delivered to the load is then:

$$P_L = \frac{1}{2}\frac{R_L\omega_0^2M^2|V_S|^2}{[(R_S + R_1)(R_2 + R_L) + \omega_0^2M^2]^2}, \tag{13}$$

and the power efficiency is the power delivered to the load divided by the maximum possible power output, $$\eta \equiv \frac{P_L}{P_{MAX}} = \frac{4R_S R_L \omega_0^2 M^2}{[(R_S + R_1)(R_2 + R_L) + \omega_0^2 M^2]^2}. \quad (14)$$

The optimum values for $R_L$ and $R_L$ may be obtained by simultaneously solving $$R_S = R_1 + \frac{\omega^2 M^2}{R_2 + R_L} \text{ and } R_L = R_2 + \frac{\omega^2 M^2}{R_1 + R_S}, \quad (15)$$

with the result that:

$$R_S = R_1\sqrt{1+k^2 Q_1 Q_2} \text{ and } R_L = R_2\sqrt{1+k^2 Q_1 Q_2}. \quad (16)$$

Figure 3:
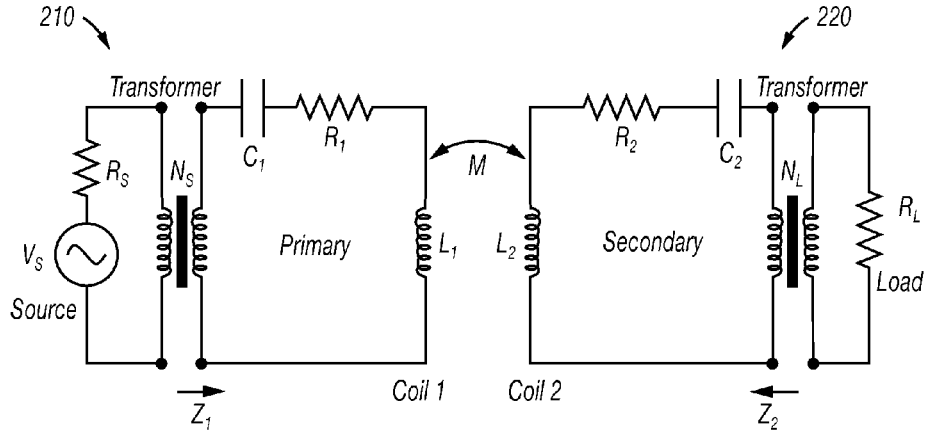
FIG. 3 is a schematic diagram of the circuit of FIG. 2, including impedance matching transformers.
Figure 4:
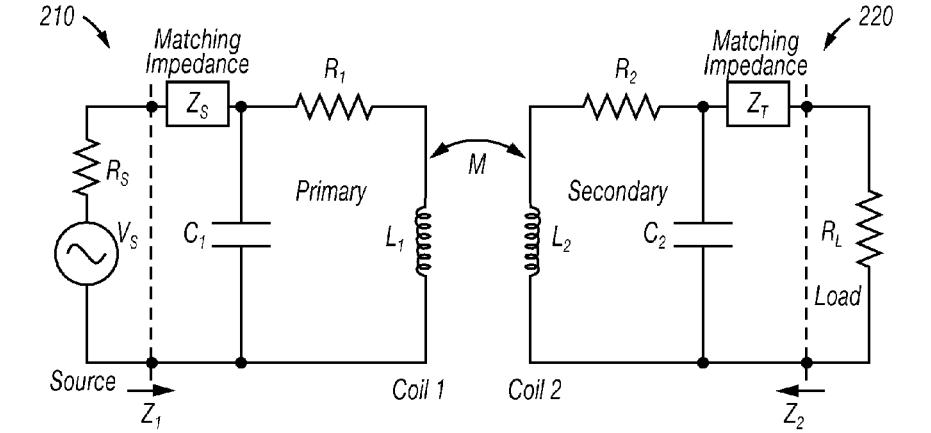
FIG. 4 is a schematic diagram illustrating a primary transmitting circuit and a secondary receiving circuit, including parallel capacitors to resonate the coils' self-inductances.

If the source and load resistances do not satisfy equations (16), then it is envisioned that standard methods may be used to transform the impedances. For example, as shown in the FIG. 3 illustration, transformers with turn ratios $N_S$:1 and $N_L$:1 may be used to match impedances as per equations (16). Alternatively, the circuit illustrated in FIG. 4 may be used. In such an embodiment in FIG. 4, parallel capacitors are used to resonate the coils' self-inductances according to equation (2). As before, $Z_1$ is defined as the impedance seen by the source looking toward the load, while $Z_2$ is defined as the impedance seen by the load looking toward the source. In addition, there are two matching impedances, $Z_S$ and $Z_T$ which may be used to cancel any reactance that would otherwise be seen by the source or load. Hence $Z_1$ and $Z_2$ are purely resistive with the proper choices of $Z_S$ and $Z_T$. Notably, the source resistance $R_S$ may equal $Z_1$, and the load resistance $R_L$ may equal $Z_2$. The procedures for optimizing efficiency with series capacitance or with parallel capacitance may be the same, and both approaches may provide high efficiencies.

Figure 5A:
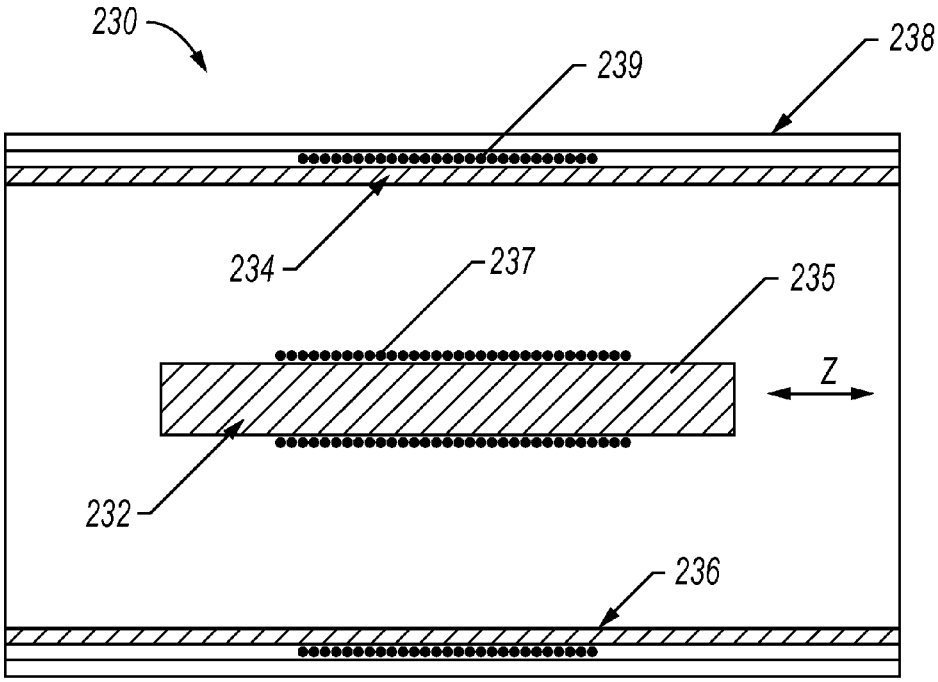
FIG. 5A is a cross-sectional diagram illustrating a primary transmitting circuit and a secondary receiving circuit, with a receiving coil inside a transmitting coil.
Figure 5B:
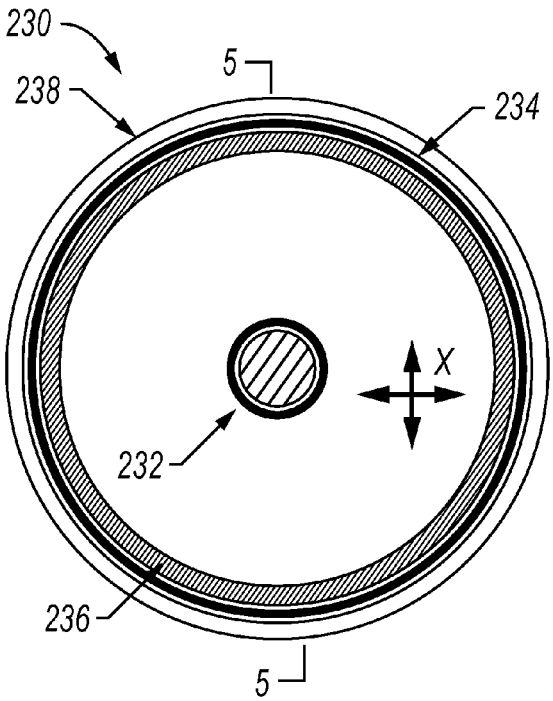
FIG. 5B is a diagram of the primary transmitting circuit and secondary receiving circuit of FIG. 5A.

Turning now to FIGS. 5A and 5B, a cross sectional view of two coils 232, 234 is illustrated in FIG. 5A (representing a view along cut lines 5-5 of FIG. 5B) and a side view of the two coils 232, 234 is illustrated in FIG. 5B. In these two figures, a receiving coil 232 inside a transmitting coil 234 of a particular embodiment 230 is depicted. The receiving coil 232 includes a ferrite rod core 235 that, in some embodiments, may be about 12.5 mm (about 0.49 inch) in diameter and about 96 mm (about 3.78 inches) long with about thirty-two turns of wire 237. Notably, although specific dimensions and/or quantities of various components may be offered in this description, it will be understood by one of ordinary skill in the art that the embodiments are not limited to the specific dimensions and/or quantities described herein.

Returning to FIGS. 5A and 5B, the transmitting coil 234 may include an insulating housing 236, about twenty-five turns of wire 239, and an outer shell of ferrite 238. The wall thickness of the ferrite shell 238 in the FIGS. 5A and 5B embodiment may be about 1.3 mm (about 0.05 inch). In certain embodiments, the overall size of the transmitting coil 234 may be about 90 mm (about 3.54 inch) in diameter by about 150 mm (about 5.90 inches) long. The receiving coil 232 may reside inside the transmitting coil 234, which is annular.

The receiving coil 232 may be free to move in the axial (z) direction or in the transverse direction (x) with respect to the transmitting coil 234. In addition, the receiving coil 232 may be able to rotate on axis with respect to the transmitting coil 234. The region between the two coils 232, 234 may be filled with air, fresh water, salt water, oil, natural gas, drilling fluid (known as "mud"), or any other liquid or gas. The transmitting coil 234 may also be mounted inside a metal tube, with minimal affect on the power efficiency because the magnetic flux may be captured by, and returned through, the ferrite shell 238 of the transmitting coil 234.

The operating frequency for these coils 232, 234 may vary according to the particular embodiment, but, for the FIG. 5 example 230, a resonant frequency f=100 kHz may be assumed. At this frequency, the transmitting coil 234 properties are: $L_1=6.76\cdot10^{-5}$ Henries and $R_1=0.053$ ohms, and the receiving coil 232 properties are $L_2=7\cdot55\cdot10^{-5}$ Henries and $R_2=0.040$ ohms. The tuning capacitors are $C_1=3.75\cdot10^{-8}$ Farads and $C_2=3.36\cdot10^{-8}$ Farads. Notably, the coupling coefficient k value depends on the position of the receiving coil 232 inside the transmitting coil 234. The receiving coil 232 is centered when x=0 and z=0 and where k=0.64.

Figure 6:
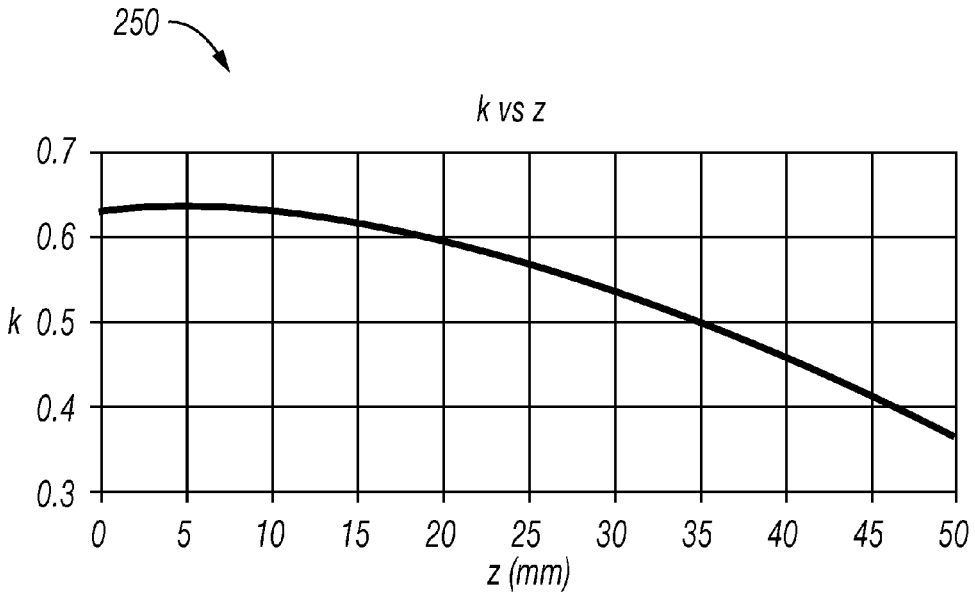
FIG. 6 is a plot diagram of a coupling coefficient, k, as a function of axial displacement of the receiving coil inside the transmitting coil.
Figure 7:
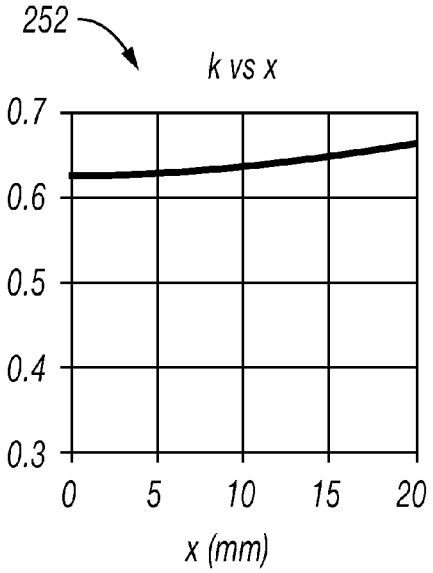
FIG. 7 is a plot diagram of a coupling coefficient, k, as a function of transverse displacement.

The variation in k versus axial displacement of the receiving coil 232 when x=0 may be relatively small, as illustrated by the graph 250 in FIG. 6. The transverse displacement when z=0 may produce very small changes ink, as illustrated by the graph 252 in FIG. 7. The receiving coil 232 may rotate about the z-axis without affecting k because the coils are azimuthally symmetric. According to equations (16), an optimum value for the source resistance may be $R_S=32$ ohms, and for the load resistance may be $R_L=24$ ohms when the receiving coil 232 is centered at x=0 and z=0. The power efficiency may thus be $\eta=99.5\%$.

Figure 8:
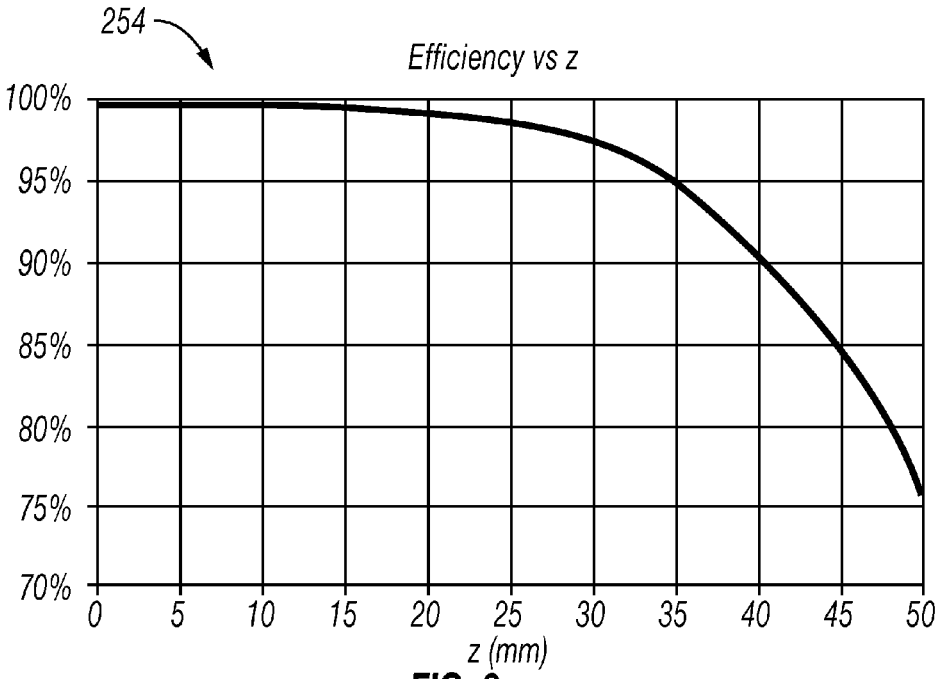
FIG. 8 is a plot diagram of power efficiency as a function of displacement in the z direction.
Figure 9:
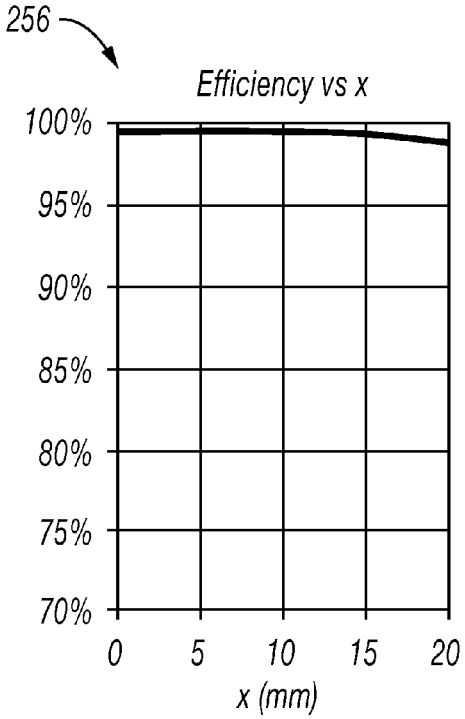
FIG. 9 is a plot diagram of power efficiency as a function of displacement in the x direction.

The power efficiency may also be calculated for displacements from the center in the z direction in mm (as illustrated by the graph 254 in FIG. 8) and in the x direction in mm (as illustrated by the graph 256 in FIG. 9). It is envisioned that the efficiency may be greater than about 99% for axial displacements up to about 20.0 mm (about 0.79 inch) in certain embodiments, and greater than about 95% for axial displacements up to about 35.0 mm (about 1.38 inches). It is further envisioned that the efficiency may be greater than 98% for transverse displacements up to 20.0 mm (about 0.79 inch) in some embodiments. Hence, the position of the receiving coil 232 inside the transmitting coil 234 may vary in some embodiments without reducing the ability of the two coils 232, 234 to efficiently transfer power.

Figure 10:
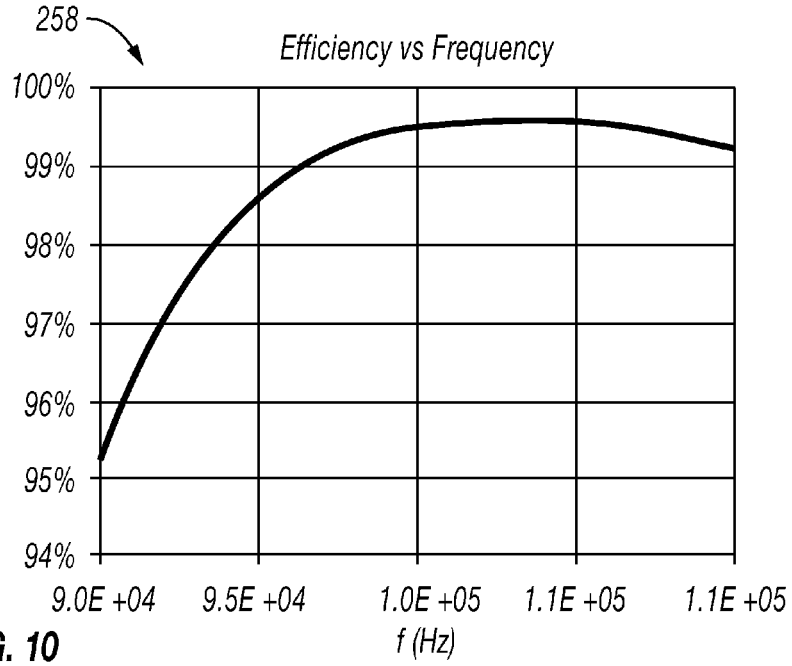
FIG. 10 is a plot diagram of power efficiency as a function of frequency.
Figure 11:
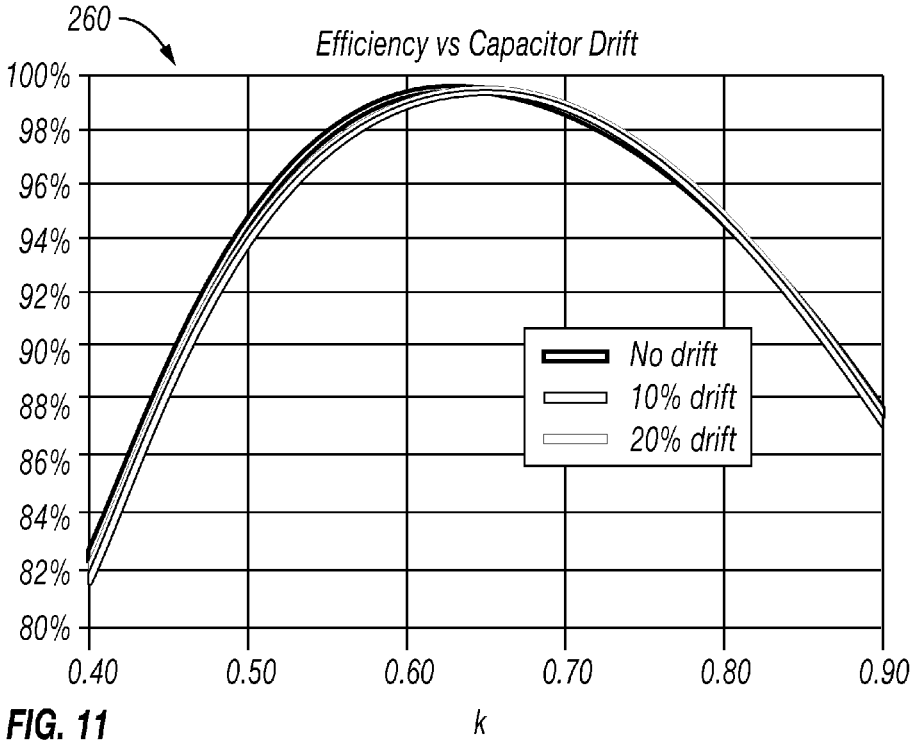
FIG. 11 is a plot diagram of power efficiency as a function of component drift.

Referring now to FIG. 10, it can be seen in the illustrative graph 258 where the Y-axis denotes efficiency in percentage and the X-axis denotes frequency in Hz that the sensitivity of the power efficiency to frequency drifts may be relatively small. A ±10% variation in frequency may produce minor effects, while the coil parameters may be held fixed. The power efficiency at 90,000 Hz is better than about 95%, and the power efficiency at 110,000 Hz is still greater than about 99%. Similarly, drifts in the component values may not have a large effect on the power efficiency. For example, both tuning capacitors $C_1$ and $C_2$ are allowed to increase by about 10% and by about 20% as illustrated in the graph 260 of FIG. 11. Notably, the other parameters are held fixed, except for the coupling coefficient k. The impact of the power efficiency is negligible. As such, the system described herein would be understood by one of ordinary skill in the art to be robust.

It is also envisioned that power may be transmitted from the inner coil to the outer coil of particular embodiments, interchanging the roles of transmitter and receiver. It is envisioned that the same power efficiency would be realized in both cases.

Figure 12:
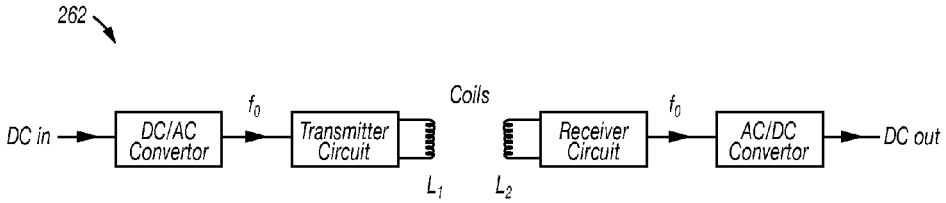
FIG. 12 is a schematic diagram illustrating the conversion of input direct current (DC) power to a high frequency alternating current (AC) signal, $f_0$, via a DC/AC converter.

Referring to FIG. 12, an electronic configuration 262 is illustrated for converting input DC power to a high frequency AC signal, $f_0$, via a DC/AC convertor. The transmitter circuit in the configuration 262 excites the transmitting coil at resonant frequency $f_0$. The receiving circuit drives an AC/DC convertor, which provides DC power output for subsequent electronics. This system 262 is appropriate for efficient passing DC power across the coils.

Figure 13:
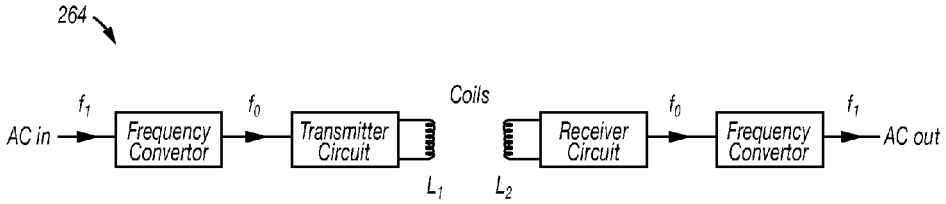
FIG. 13 is a schematic diagram illustrating a passing of AC power through the coils of a transmitting circuit and a receiving circuit.

Turning to FIG. 13, AC power can be passed through the coils. Input AC power at frequency $f_1$ is converted to resonant frequency $f_0$ by a frequency convertor. Normally this would be a step up convertor with $f_0 >> f_1$. The receiver circuit outputs power at frequency $f_0$, which is converted back to AC power at frequency $f_1$. Alternatively, as one of ordinary skill in the art recognizes, the FIG. 13 embodiment 264 could be modified to accept DC power in and produce AC power out, and vice versa.

In lieu of, or in addition to, passing power, data signals may be transferred from one coil to the other in certain embodiments by a variety of means. In the above example, power is transferred using an about 100.0 kHz oscillating magnetic field. It is envisioned that this oscillating signal may also be used as a carrier frequency with amplitude modulation, phase modulation, or frequency modulation used to transfer data from the transmitting coil to the receiving coil. Such would provide a one-way data transfer.

An alternative embodiment includes additional secondary coils to transmit and receive data in parallel with any power transmissions occurring between the other coils described above, as illustrated in FIG. 14. Such an arrangement may provide two-way data communication in some embodiments. The secondary data coils 266, 268 may be associated with relatively low power efficiencies of less than about 10%. It is envisioned that in some embodiments the data transfer may be accomplished with a good signal to noise ratio, for example, about 6.0 dB or better. The secondary data coils 266, 268 may have fewer turns than the power transmitting 234 and receiving coils 232.

Figure 14:
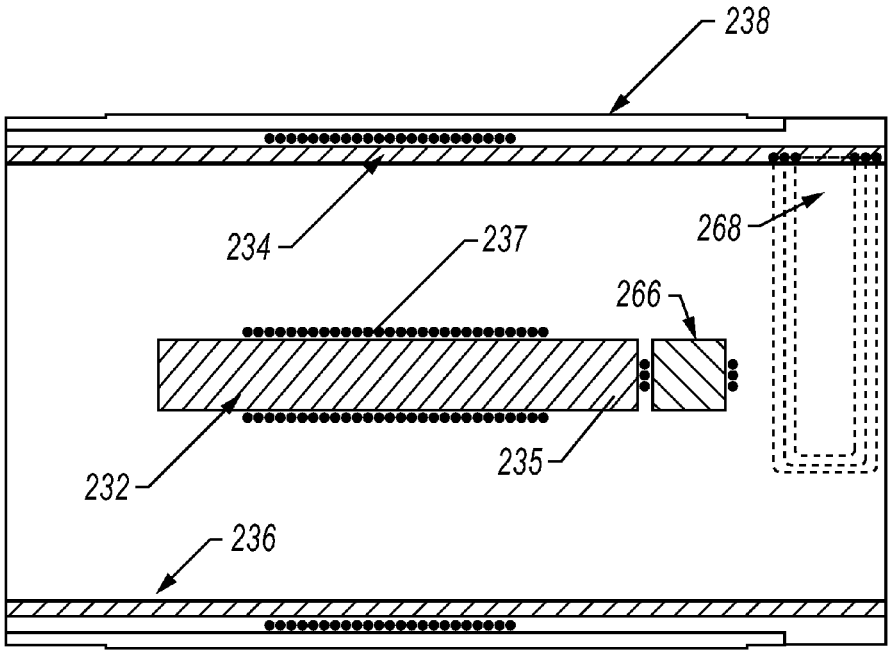
FIG. 14 is a diagram illustrating a primary transmitting circuit and a secondary receiving circuit, including an additional secondary coil orthogonal to the power coils.

The secondary data coils 266, 268 may be orthogonal to the power coils 232, 234, as illustrated in FIG. 14. For example, the magnetic flux from the power transmitting coils 232, 234 may be orthogonal to a first data coil 266, so that it does not induce a signal in the first data coil 266. A second data coil 268 may be wrapped as shown in FIG. 14 such that magnetic flux from the power transmitters does not pass through it, but magnetic flux from first data coil 266 does. Notably, the configuration depicted in FIG. 14 is offered for illustrative purposes only and is not meant to suggest that it is the only configuration that may reduce or eliminate the possibility that a signal will be induced in one or more of the data coils by the magnetic flux of the power transmitting coils. Other data coil configurations that may minimize the magnetic flux from the power transmitter exciting the data coils will occur to those with ordinary skill in the art.

Moreover, it is envisioned that the data coils 266, 268 may be wound on a non-magnetic dielectric material in some embodiments. Using a magnetic core for the data coils 266, 268 might result in the data coils' cores being saturated by the strong magnetic fields used for power transmission. Also, the data coils 266, 268 may be configured to operate at a substantially different frequency than the power transmission frequency. For example, if the power is transmitted at about 100.0 kHz in a certain embodiment, then the data may be transmitted at a frequency of about 1.0 MHz or higher. In such an embodiment, high pass filters on the data coils 266, 268 may prevent the about 100.0 kHz signal from corrupting the data signal. In still other embodiments, the data coils 266, 268 may simply be located away from the power coils 232, 234 to minimize any interference from the power transmission. It is further envisioned that some embodiments may use any combination of these methods to mitigate or eliminate adverse effects on the data coils 266, 268 from the power transmission of the power coils 232, 234.

Application to Measurements at the Bit in Positive Displacement Motors

Figure 15:
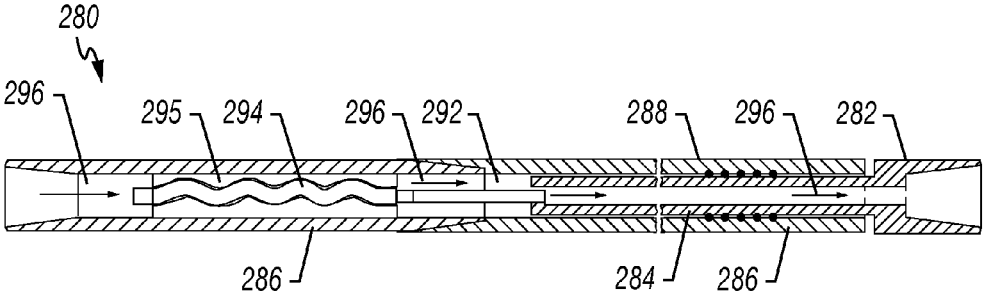
FIG. 15 is a diagram of a positive displacement motor (PDM) assembly.

As described above, Positive Displacement Motors ("PDM") or "mud motors" are run in the bottom hole assembly ("BHA") to increase the revolutions per minute ("RPM") of the drill bit, or as part of a steerable system when combined with a bent sub. A typical PDM assembly 280 (See also PDM 150 in FIG. 1B) is shown in FIG. 15. The drill bit is attached to a bit box 282, which is attached in turn to a drive shaft 284. The axial load on the drive shaft 284 is transferred to the drill collar 286 by the bearing section 288. The bearing section 288 permits the drive shaft 284 to rotate freely with respect to the drill collar 286. The drive shaft 284 is attached to a flex shaft 292, which is attached to a rotor 294. The drive shaft 284, flex shaft 292 and rotor 294 rotate with respect to the drill collar 286. Drilling fluid ("mud") flowing through the drill collar 286 provides power to the rotor 294, as represented by the arrows 296.

Figure 16:
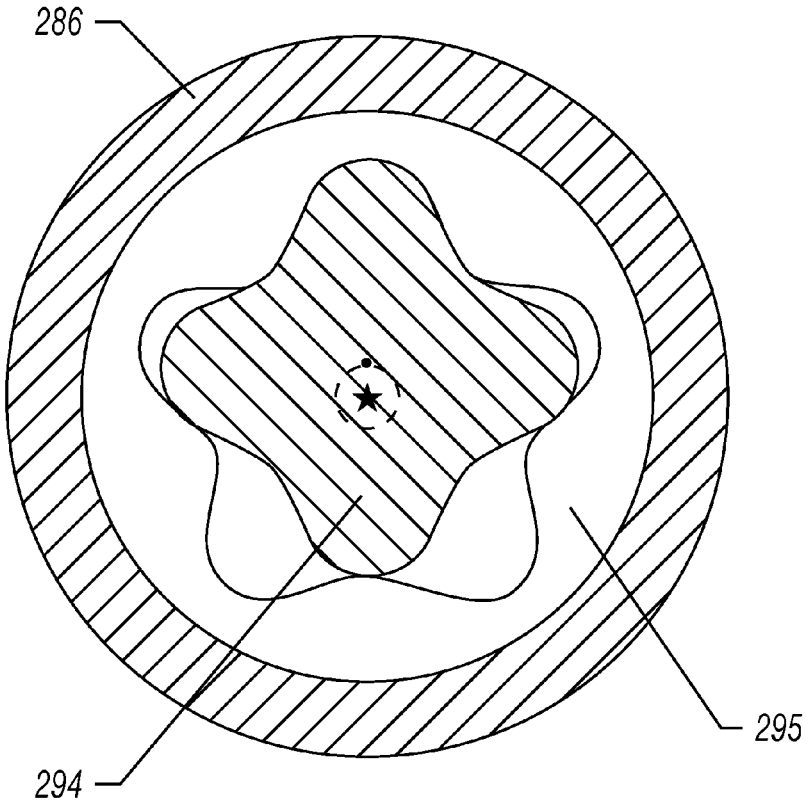
FIG. 16 is a cross-sectional diagram of the drill collar, rubber stator and rotor of the positive displacement motor (PDM) assembly of FIG. 15.

Referring to FIG. 16, a cross-sectional view of the drill collar 286, rubber stator 295, and rotor 294 of the PDM assembly 280 of FIG. 15 is shown. The mud flows through the mud motor in the spaces between the rubber stator 295 and the rotor 294. As understood by one of ordinary skill in the art, the mud pressure on the spiral grooves in the stator 295 and on the spiral fins on the rotor 294 turns the rotor 294. However, the axis of the rotor 294 is not stationary, but rather orbits in a small circle about the axis of the stator 295. The orbital motion occurs as the fins of the rotor 294 are forced into the grooves of the stator 295. In addition, the rotor 294 may also move in the axial direction as the pressure drop along the rotor 294 changes. Thus the rotor position is constantly changing by a substantial amount with respect to the drill collar 286 (e.g. by centimeters/inches). Referring back to FIG. 15, the flexible steel shaft (flex shaft) 292 attached to the rotor 294 may operate to absorb the variation in the rotor's position.

Mud motors are complex mechanical assemblies that may be 30 feet long or longer. There is very little space available to run wires through the mud motor or to mount sensors or electronics in them. This limits the possibilities for making measurements at the bit, since providing electrical power and communications through the mud motor may be very difficult. Instead, sensors and electronics that are run below the mud motor often may provide their own power supply, which adds length and cost. To communicate past the mud motor, a relatively inefficient and expensive electromagnetic wave transmission system may be used. The electromagnetic waves travel through the formation and are susceptible to losses in a low resistivity formation.

Difficulties may occur with passing power and communications using wires through the mud motor due to the rotation, orbital and axial motion of the rotor with respect to the drill collar. Wires attached to the upper end of the rotor and connected to the electronics in the drill collar are subjected to the rotation, orbital and axial movement of the rotor. Therefore, there may be an electrical connection that allows the wires to rotate, for example, a set of slip rings. The slip rings may have to be housed in an oil-filled chamber with rotating O-ring seals. However, such O-ring system is a relatively unreliable, costly, and maintenance intensive component. A flexible spring-like structure also is needed to absorb the orbital and axial motion of the rotor. This is potentially an unreliable component due to the constant motion which would fatigue the wires. The two components also add relatively significant length to the mud motor, moving the MWD further from the drill bit.

Figure 17:
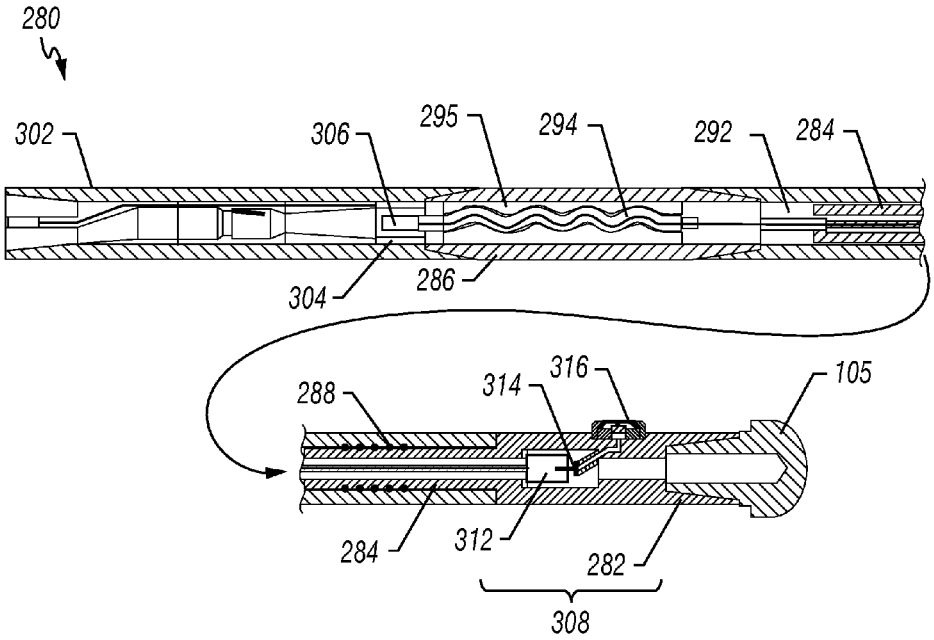
FIG. 17 is a diagram of a positive displacement motor (PDM) assembly using wires to provide power and communications through the mud motor.

A method for providing power and communications using wires run through the mud motor is shown in FIG. 17. A float valve 302 is located above the motor, as may be done on occasion. This is not a necessary component, but is shown to illustrate a possible configuration. Power is supplied by a turbine or by batteries located in a sub above the float valve 302. Wires pass through the float valve 302 and connect to an annular coil 304, for example, as previously described and as shown in FIGS. 5 and 14. Power is transmitted through the annular coil 304 to a second, mandrel coil 306, which is attached to the rotor 294. As shown in FIGS. 8 and 9, power can be transmitted relatively efficiently from one coil to the other coil, despite relative movement and misalignment of the two coils. According to the previous results, the relative position of the coils can move approximately ±3 cm axially and approximately 2 cm radially without impacting the efficiency for power transfer.

Similarly, communications can be provided by a second, smaller set of coils mounted in this region, as shown in FIG. 14. The mandrel coil 306 is attached to wires that are routed through a hole in the center of the rotor 294, through a hole in the center of the flex shaft 292, and thorough a tube that extends into the bit box 282. At the bit box 282, an electric connection may be made to a sub containing sensors, electronics, a processor and an electric motor or actuator. Thus, the sub is powered by the wires through the mud motor, and communicates with MWD equipment located above the float valve.

Rotary steerable systems (RSS) are used to control the direction and inclination of the borehole by exerting side forces on the drill bit 105 and/or the drill collar 286, or by pointing the drill bit 105 in a particular direction.

Figure 18:
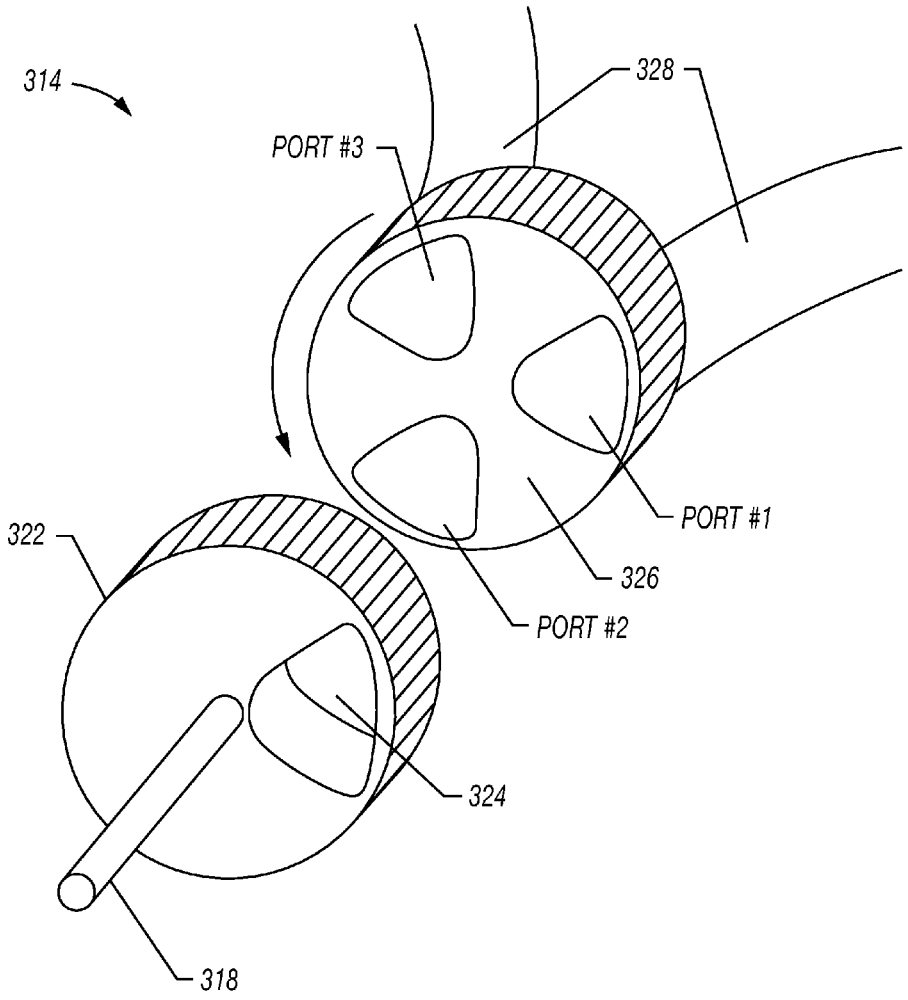
FIG. 18 is an exploded view of a spider valve in the positive displacement motor (PDM) assembly of FIG. 17.

FIG. 17 illustrates the integration of one version of a RSS with a PDM 280. The drill bit 105 is attached to a subassembly 308 containing electronics (including a processor or controller), sensors, an electric motor (shown collectively as 312), a "spider valve" 314 and one or more pads 316. Power is provided by the wires, which pass through the PDM 280, e.g., as described hereinabove. Sensors are used to determine which direction is down, e.g., by using magnetometers, accelerometers, and/or an inertial navigation system. The "down" direction is known in the industry as gravity tool face. The processor uses the measured gravity tool face to control an electric motor. The electric motor turns a control shaft that is attached to the spider valve 314, shown in an exploded view in FIG. 18.

Figure 19:
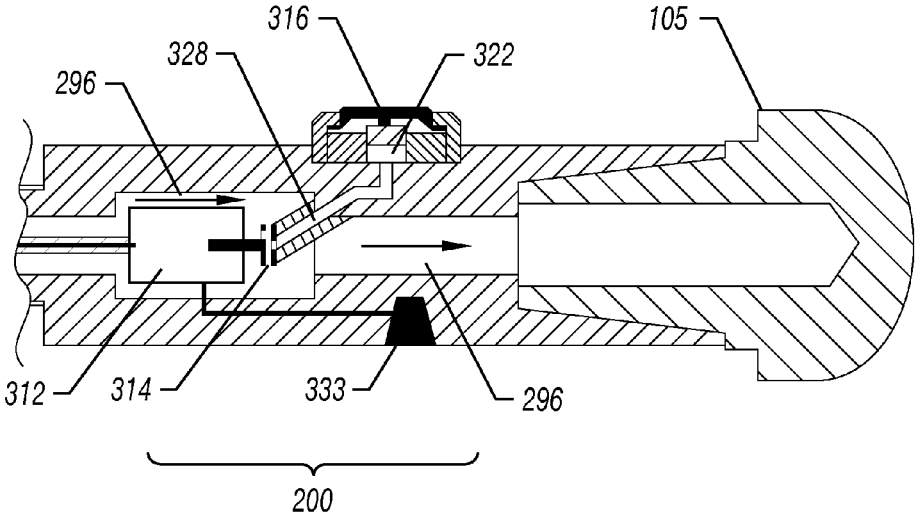
FIG. 19 is a cross-sectional diagram of a portion of the positive displacement motor (PDM) assembly of FIG. 17.

The spider valve 314 includes two metal disks, which are normally in relatively close proximity to one another. A first disk 322 may have one opening or port 324 and is attached to the control shaft 318. The orientation of the first disk 322 is controlled by the electric motor (not shown). A second disk 326 may have three ports, labeled port #1, port #2, and port #3. Each port in the second disk 326 is attached to a hydraulic line 328, which connects to a hydraulic piston 322, as shown in FIG. 19. When the port 324 in the first disk 322 aligns with a port in the second disk 326, drilling fluid enters the corresponding hydraulic line 328 and activates the attached hydraulic piston 332, which forces a hinged pad 316 to push against the borehole wall.

To drill a curved trajectory in a desired direction, the processor causes the opening in the first disk 322 to maintain a constant orientation with respect to a gravity tool face. The RSS collar 286 and the drill bit 105 rotate due to the PDM 280 and also due to rotation of the entire drill string by the drilling rig. By rotating the first disk 322 in the opposite manner to the rotation of the drill bit 105, the port in the first disk 322 stays in the same orientation. For example, if the RSS collar rotates in the clockwise direction, the electric motor rotates the first disk 322 in the counter-clockwise direction and with the same RPM as the RSS collar. As the second disk 326 is attached to the RSS collar and rotates with it, ports #1, #2, and #3 pass in front of the port in the first disk 322. The corresponding pad to each port thus presses against the borehole wall and this provides a continuous side force to deflect the drill bit 105 into a particular direction.

To drill a straight hole, the electric motor rotates the first disk 322 at a slightly different RPM than the RSS collar, and the average deflection is thus zero.

There are several advantages of this system over running a conventional RSS below a PDM. First, integrating the RSS into the PDM bit box reduces the length of drill collars between the drill bit and the PDM. This reduces the load on the PDM and allows for more torque to be delivered to the drill bit. It also reduces the distance between any LWD or MWD sensor located above the PDM. A conventional RSS may add at least 15 feet between the drill bit and the PDM. Several more feet may be added if a short hop telemetry system is added for communications. The turbine and torque are may be replaced by the wires transmitting power, and the short-hop system may be replaced by the wire-borne communications.

Second, the electronics and electric motor rotate with the RSS drill collar. This means that sensors can be mounted in the drill collar, as illustrated in FIG. 19. For example, an ultrasonic caliper 333 can be mounted in the drill collar. The ultrasonic caliper contains a piezoelectric crystal which emits an ultrasonic pulse. The round trip time after the pulse is reflected from the borehole wall is converted into a distance. Other sensors might include: azimuthal gamma-ray, resistivity, borehole imaging, weight on bit, torque on bit, shock and vibration. By monitoring weight on bit, torque on bit, and RPM, the driller is able to improve the rate of penetration. Special purpose sensors monitor the proper activation of the pads. For example, proper operation of the system is obtained by measuring the positions of the pads or by measuring the pressure in the hydraulic lines or pistons.

Figure 20:
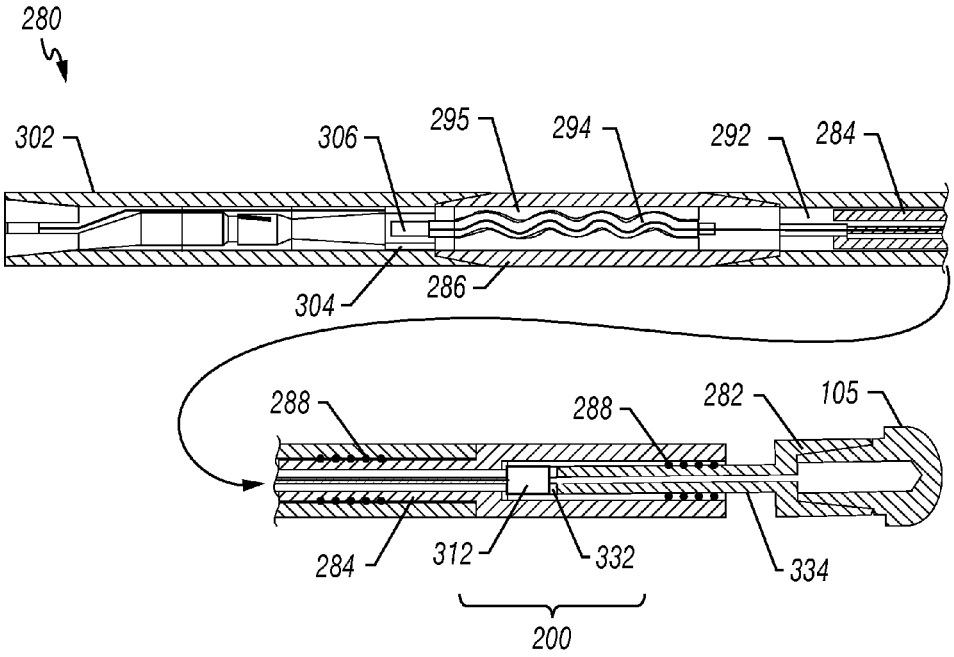
FIG. 20 is a cross-sectional diagram of a positive displacement motor (PDM) assembly.

A different type of rotary steerable system is shown in FIG. 20. This second system points the drill bit 105 in the desired direction. Power and communications are provided by wires in the PDM as described hereinabove. The drive shaft 284 of the PDM 280 connects to a drill collar containing electronics, processor, sensors, electric motor (shown as 312), an eccentric coupling 332, and a cantilevered shaft 334. The drill bit 105 is attached to the bottom of the cantilevered shaft 334, which is set at a small angle with respect to the main drill collar axis. The cantilevered shaft 334 is allowed to pivot about a section of bearings 288, while the bearings 288 transmit the torque and weight of the drill string to the drill bit 105. The top end of the cantilevered shaft 334 is attached to the eccentric coupling 332, which is attached in turn to an electric motor 312. As before, sensors measure the gravity tool face.

To drill a curved trajectory in a desired direction, the processor causes the motor to counter-rotate the eccentric coupling 332 to maintain a constant orientation with respect to gravity tool face. By rotating the eccentric coupling 332 opposite to the rotation of the drill collar 280, the drill bit 105 is pointed in the desired direction. To drill a straight hole, the electric motor rotates the eccentric coupling 332 at a slightly different RPM than the drill collar 280, and the average deflection is thus zero.

As for the first example, the same benefits are obtained for this point-the-bit system. The length of drill string between the PDM and the drill bit is reduced. This design also offers the possibility of mounting sensors in the drill collar wall.

The system described above mentions how power may flow from above the PDM to the rotary steerable system ("RSS"). The system may transmit power in either direction and/or in both directions as understood by one of ordinary skill in the art.

The disclosed methods and systems may efficiently pass power from a tool located above the mud motor to the rotor via two coils. One coil is annular and located in the ID of the drill collar. The other coil is attached to the rotor and is located within the first coil. The coils are high Q and resonated at the same frequency. The impedance of the power source is matched to the impedance looking toward the transmitting coil. The impedance of the load is matched to the impedance looking back toward the source.

Advantages of the disclosed methods and systems include, but are not limited to, the second coil of the two coils being able to rotate and to move in the axial and radial directions without loss of efficiency. According to the inventive method and system, room exits for mud to flow through the two coils.

Power may be transmitted from the tool above the motor to the bit by passing the wires through the rotor. The steerable system may be located near the bit, powered from above the mud motor via the magnetic coupling.

The steerable system may include a spider valve and pressure activated pads to push the bit in a desired direction. The steerable system may include a cantilevered shaft and an eccentric to point the bit in a desired direction. Further, power may be transmitted from the tool above the motor to the bit by passing the wires through the rotor.

Various sensors of the disclosed methods and systems may be located at the bit, powered by the tool located above the mud motor. Another advantage of the method and systems described herein is that two way communications may be made through the mud motor by adding a second set of coils.

The disclosed methods and systems may provide for efficient power transfer. According to one aspect, power may be transmitted between two coils where the two coils do not have to be in close proximity (see equation 1 discussed above) in which k may be less than (<1) or equal to one. Another potential distinguishing aspect of the disclosed methods and systems includes resonating the power transmitting coil with a high quality factor (see equation 3 discussed above) in which Q may be greater than (>) or equal to 10. Another distinguishing aspect of the system and method may include resonating the power transmitting coil with series capacitance (see equation 2 listed above).

Other unique aspects of the disclosed methods and systems may include resonating the power transmitting coil with parallel capacitance and resonating the power receiving coil with a high quality factor Q (see equation 3) in which Q is greater than (>) or equal to 10. Other unique features of the disclosed methods and systems may include resonating the power receiving coil with series capacitance (see equation 2 discussed above) as well as resonating the power receiving coil with parallel capacitance.

Another unique feature of the disclosed methods and systems may include resonating the transmitting coil and the receiving coil at similar frequencies (see equation 2 described above) as well as matching the impedance of the power supply to the impedance looking toward the transmitting coil (see equation 10 described above). Another distinguishing feature of the disclosed methods and systems may include matching the impedance of the load to the impedance looking back toward the receiving coil (see equation 12).

An additional distinguishing aspect of the disclosed methods and systems may include using magnetic material to increase the coupling efficiency between the transmitting and the receiving coils. Further, the inventive method and system may include a power receiving coil that includes wire wrapped around a ferrite core (for example, see FIGS. 5B and 14). Meanwhile, the power transmitting coil may include a wire located inside a ferrite core (see FIGS. 5B and 14). According to another aspect, the power receiving coil may be located inside the power transmitting coil (see FIGS. 5B and 14).

Although a few embodiments have been described in detail above, those skilled in the art will readily appreciate that many modifications are possible in the embodiments without materially departing from this disclosure. Accordingly, such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A system comprising:

a bit box formed at a first end of a drill collar, the bit box configured to couple a drill bit thereto;

a motor positioned within the drill collar;

a magnetic coupling arrangement positioned within the drill collar and electrically coupled to the motor to provide power to the motor, wherein the magnetic coupling arrangement includes a first cylindrical coil located within a second cylindrical coil, wherein the first cylindrical coil and the second cylindrical coil are loosely coupled according to the following relationship:

$$k=M/\sqrt{L_1L_2}\leq 0.9,$$

where k represents a coupling coefficient of the first cylindrical coil and the second cylindrical coil, M represents a mutual inductance between the first cylindrical coil and the second cylindrical coil, $L_1$ represents a self-inductance of the first cylindrical coil, and $L_2$ represents a self-inductance of the second cylindrical coil, wherein the first cylindrical coil is resonantly tuned with a first capacitor and the second cylindrical coil is resonantly tuned with a second capacitor such that the first cylindrical coil and the second cylindrical coil resonate at approximately the same frequency according to the following relationship:

$$f_1=\frac{1}{2\pi\sqrt{L_1C_1}},\ f_2=\frac{1}{2\pi\sqrt{L_2C_2}},\ f_1\approx f_2,$$

where $f_1$ represents a frequency of the first cylindrical coil, $f_2$ represents a frequency of the second cylindrical coil, $C_1$ represents a capacitance of the first capacitor, and $C_2$ represents a capacitance of the second capacitor, wherein a figure of merit between the first cylindrical coil and the second cylindrical coil is equal to or greater than 3 according to the following relationship:

$$U=k\sqrt{Q_1Q_2}\geq 3,\text{ where}$$

$$Q_1 = \frac{2\pi f_1 L_1}{R_1} \text{ and } Q_2 = \frac{2\pi f_2 L_2}{R_2}$$

where U represents the figure of merit, $Q_1$ represents a quality factor of the first cylindrical coil, $Q_2$ represents a quality factor of the second cylindrical coil, $R_1$ represents a resistance of the first cylindrical coil, and $R_2$ represents a resistance of the second cylindrical coil; and a steering system positioned within the drill collar and coupled between the motor and the bit box for steering a direction of the bit box with respect to an axis of the drill collar in response to the operation of the motor.

2. The system as recited in claim 1, wherein the magnetic coupling arrangement includes:

a transmitter circuit coupled to the drill collar, wherein the transmitter circuit has a power transmitting coil, and a receiver circuit coupled to a rotor within the drill collar, wherein the receiver circuit has a power receiving coil, wherein the transmitter circuit and the receiver circuit are positioned with respect to one another such that power is coupled from the power transmitting coil to the power receiving coil whereby the receiver coil powers the motor.

3. The system as recited in claim 2, wherein the magnetic coupling arrangement includes:

a first data coil, and a second data coil magnetically coupled to the first data coil, wherein the first data coil and the second data coil are positioned with respect to one another such that data is communicated between the first data coil and the second data.

4. The system as recited in claim 1, wherein the steering system includes:

a valve coupled to the motor;

at least one hydraulic line coupled to the valve, a hydraulic piston coupled to the at least one hydraulic line, and a pressure activated pad coupled to the hydraulic piston, wherein the motor aligns the valve in such a way that drilling fluid enters the hydraulic line to operate the hydraulic piston, and wherein the hydraulic piston moves the pressure activated pad against a borehole wall within which the drill collar is positioned in such a way that steers the direction of the drill collar within respect to the borehole wall.

5. The system as recited in claim 1, wherein the steering system includes:

an eccentric coupling device coupled to the motor, and a cantilevered shaft coupled between the eccentric coupling device and the bit box, wherein the motor rotates the eccentric coupling device in such a way that the cantilevered shaft pivots thereby steering the direction of the bit box with respect to the axis of the drill collar.

6. The system as recited in claim 1, further comprising a processor positioned within the interior of the drill collar and coupled to the motor for controlling the operation of the motor.

7. The system as recited in claim 6, further comprising at least one sensor mounted in the drill collar and coupled to the processor for sending information to the processor, wherein the processor operates the motor in response to information received from the at least one sensor.

8. The system as recited in claim 7, wherein the at least one sensor includes at least one of magnetometer, accelerometer, and an inertial navigation system.

9. The system as recited in claim 1, wherein the motor and the steering system are positioned within the drill collar in such a way that the motor and the steering system rotate with the drill collar.

10. An apparatus, comprising:

a drill collar;

a bit box formed at a first end of the drill collar, the bit box configured to couple a drill bit thereto;

a rotor for a mud motor;

an electric motor positioned within the drill collar;

a magnetic coupling arrangement coupled between the drill collar and the rotor, wherein the magnetic coupling arrangement couples power to cause the drill collar to rotate the rotor, and wherein the magnetic coupling arrangement is electrically coupled to the electric motor to provide power to the electric motor, wherein:

the magnetic coupling arrangement includes a first cylindrical coil located within a second cylindrical coil;

the first cylindrical coil and the second cylindrical coil are coupled with a coupling coefficient of less than or equal to 0.9;

the first cylindrical coil is resonantly tuned with a first capacitor and the second cylindrical coil is resonantly tuned with a second capacitor to cause a frequency of the first cylindrical coil to be substantially the same as a frequency of the second cylindrical coil; and a figure of merit between the first cylindrical coil and the second cylindrical coil is equal to or greater than 3; and a steering system positioned within the drill collar and coupled between the electric motor and the bit box for steering the direction of the bit box with respect to the axis of the drill collar in response to the operation of the electric motor.

11. The apparatus as recited in claim 10, wherein the magnetic coupling arrangement includes:

a transmitter circuit coupled to the drill collar, wherein the transmitter circuit has a power transmitting coil, and a receiver circuit coupled to the rotor and electrically coupled to the electric motor, wherein the receiver circuit has a power receiving coil, wherein the transmitter circuit and the receiver circuit are positioned with respect to one another such that power is coupled from the power transmitting coil to the power receiving coil whereby the drill collar rotates the rotor and whereby the receiver coil powers the electric motor.

12. The apparatus as recited in claim 10, wherein the steering system includes:

a valve coupled to the electric motor;

at least one hydraulic line coupled to the valve, a hydraulic piston coupled to the at least one hydraulic line, and a pressure activated pad coupled to the hydraulic piston, wherein the electric motor aligns the valve in such a way that drilling fluid enters the hydraulic line to operate the hydraulic piston, and wherein the hydraulic piston moves the pressure activated pad against a borehole wall within which the drill collar is positioned in such a way that steers the direction of the drill collar within respect to the borehole wall.

13. The apparatus as recited in claim 10, wherein the steering system includes:

an eccentric coupling device coupled to the electric motor, and a cantilevered shaft coupled between the eccentric coupling device and the bit box, wherein the electric motor rotates the eccentric coupling device in such a way that the cantilevered shaft pivots thereby steering the direction of the bit box with respect to the axis of the drill collar.

14. The apparatus as recited in claim 10, further comprising a processor positioned within the interior of the drill collar and coupled to the electric motor for controlling the operation of the electric motor.

15. The apparatus as recited in claim 14, further comprising at least one sensor mounted in the drill collar and coupled to the processor for sending information to the processor, wherein the processor operates the electric motor in response to information received from the at least one sensor.

16. A method comprising:

magnetically coupling power to a motor positioned within a drill collar, wherein:

the power is magnetically coupled via a magnetic coupling arrangement that includes a power transmitting coil and a power receiving coil;

the power transmitting coil and the power receiving coil are coupled with a coupling coefficient of less than or equal to 0.9;

the power transmitting coil is resonantly tuned with a first capacitor and the power receiving coil is resonantly tuned with a second capacitor to cause a frequency of the power transmitting coil to be substantially the same as a frequency of the power receiving coil; and a figure of merit between the power transmitting coil and the power receiving coil is equal to or greater than 3; and steering with a steering system coupled to the motor a direction of a bit box formed at an end of the drill collar with respect to an axis of the drill collar in response to the operation of the motor.

17. The method as recited in claim 16, wherein power is magnetically coupled to the motor by the magnetic coupling arrangement, wherein the magnetic coupling arrangement includes:

a transmitter circuit coupled to the drill collar, wherein the transmitter circuit has the power transmitting coil, and a receiver circuit coupled to a rotor within the drill collar, wherein the receiver circuit has the power receiving coil, wherein the transmitter circuit and the receiver circuit are positioned with respect to one another such that power is coupled from the power transmitting coil to the power receiving coil whereby the receiver coil powers the motor.

18. The method as recited in claim 16, wherein the magnetic coupling arrangement includes:

a first data coil, and a second data coil magnetically coupled to the first data coil, wherein the first data coil and the second data coil are positioned with respect to one another such that data is communicated between the first data coil and the second data.

19. The method as recited in claim 16, wherein the steering system includes:

a valve coupled to the motor;

at least one hydraulic line coupled to the valve, a hydraulic piston coupled to the at least one hydraulic line, and a pressure activated pad coupled to the hydraulic piston, wherein the motor aligns the valve in such a way that drilling fluid enters the hydraulic line to operate the hydraulic piston, and wherein the hydraulic piston moves the pressure activated pad against a borehole wall within which the drill collar is positioned in such a way that steers the direction of the drill collar within respect to the borehole wall.

20. The method as recited in claim 16, wherein the steering system includes:

an eccentric coupling device coupled to the motor, and a cantilevered shaft coupled between the eccentric coupling device and the bit box, wherein the motor rotates the eccentric coupling device in such a way that the cantilevered shaft pivots thereby steering the direction of the bit box with respect to the axis of the drill collar.

* * * * *